US006928661B2

(12) United States Patent
Lewis et al.

(10) Patent No.: US 6,928,661 B2
(45) Date of Patent: Aug. 16, 2005

(54) PANTS HAVING AN EASY TO OPEN FRONT AREA AND METHOD THEREFOR

(76) Inventors: Thomas E. Lewis, 2563 Pera Cir., Las Vegas, NV (US) 89121; Kathleen Krizka, 2563 Pera Cir., Las Vegas, NV (US) 89121

( * ) Notice: Subject to any disclaimer, the term of this patent is extended or adjusted under 35 U.S.C. 154(b) by 0 days.

(21) Appl. No.: 10/863,408

(22) Filed: Jun. 8, 2004

(65) Prior Publication Data

US 2004/0261156 A1 Dec. 30, 2004

Related U.S. Application Data

(60) Provisional application No. 60/482,066, filed on Jun. 24, 2003.

(51) Int. Cl.[7] ..... A41D 1/00
(52) U.S. Cl. ..... 2/227; 2/235
(58) Field of Search ..... 2/227, 228, 238, 2/79, 69, 69.5, 80, 83, 235, 114, 237, 78.1–78.4, 73, 81, 82, 2.15–2.17

(56) References Cited

U.S. PATENT DOCUMENTS

| | | | | |
|---|---|---|---|---|
| 1,083,712 A | | 1/1914 | Uyeda | |
| 1,568,449 A | | 1/1926 | Gardner | |
| 1,587,099 A | | 6/1926 | Williams | |
| 1,660,222 A | | 2/1928 | Dwyer | |
| 2,264,958 A | | 12/1941 | Smith | |
| 2,588,542 A | | 3/1952 | Kunz | |
| 2,622,248 A | | 12/1952 | Schaye | |
| 3,425,063 A | | 2/1969 | Brown | |
| 4,578,828 A | * | 4/1986 | Smith et al. | 2/234 |
| 4,961,234 A | | 10/1990 | Leibman | |
| 5,010,595 A | | 4/1991 | Stadley | |
| 5,341,515 A | * | 8/1994 | Cohen | 2/400 |
| 5,983,401 A | * | 11/1999 | Ohara | 2/227 |
| 6,192,522 B1 | | 2/2001 | Schreib | |
| 6,243,878 B1 | * | 6/2001 | Khemka et al. | 2/227 |
| 6,477,716 B2 | | 11/2002 | Blaire | |

* cited by examiner

*Primary Examiner*—Gloria M. Hale
(74) *Attorney, Agent, or Firm*—Jeffrey D. Moy; Harry M. Weiss; Weiss, Moy & Harris, P.C.

(57) ABSTRACT

A unisex garment has a waistband. A pair of leg members extend down from the waistband. A mechanism is coupled to the unisex garment to allow easy opening of the crotch area to access the genitals. The mechanism comprises a zipper running from a crotch seam positioned between the pair of leg members to a belt line just below the waistband wherein upward movement of a handle will open the zipper. A plurality of quick release fasteners run from a top section of the crotch seam towards pant inseams on both pair of leg members.

10 Claims, 2 Drawing Sheets

PANTS HAVING AN EASY TO OPEN FRONT AREA AND METHOD THEREFOR

RELATED APPLICATIONS

This patent application is claiming the benefit of the U.S. Provisional Application having an application number of 60/482,066, filed Jun. 24, 2003, in the name of Thomas E. Lewis and Kathleen Krizka, and entitled "EASY ACCESS FRONT FLY FOR PANTS".

BACKGROUND OF THE INVENTION

1. Field of the Invention

This invention relates to clothing and, more specifically, to a pair of pants/shorts which would have an easy to open front area to allow an individual to have easy access to the genital area for restroom usage or other reasons.

2. Description of the Prior Art

Most pants-type garments such as slacks, shorts, jump suits, etc. (hereinafter pants) are designed so that the wearer must partially or completely disrobe in order to access the genital area to relieve bodily functions or for other reasons. In general, the wearer has to undo a belt buckle, unbutton the pants, pull down the zipper, and lower the pants below one's waist. Obviously such arrangements are quite inconvenient particularly when away from home, as in a public restroom, in the out-of-doors, at a doctor's office, etc. The above is also quite inconvenient for people in uniforms such as athletes, pilots, truck drivers, etc., as well as hospital patients, disabled persons, and the elderly.

Prior art patents have issued which allow faster access to the genital area. However, these patents have several flaws. Many prior art patents disclose the use of buttons which hold together the pants around the crotch area. The buttons can be undone to allow easy access to the genital area. Unfortunately, one has to undo quite a few buttons to gain access to the genital area. This is extremely time consuming. Furthermore, undoing a plurality of buttons can be difficult for young children and older adults who may not have full dexterity of the fingers.

Many of the prior art patents disclose the use of long zippers to allow easy access to the genital area. The zippers need to be pulled completely down in order to access the genital area. Pulling zippers in a downward manner can be difficult. Many times the zipper tends to bend and one must straighten the zipper area to align the zipper in order to pull the zipper down.

Another problem with the prior art is that in all the prior art patents, the mechanism to allow easy access to the genital area is always visible. Many people feel uncomfortable wearing pants knowing that one could easily open their pants in public.

Therefore, there is a need to provide an improved mechanism to allow easy access to the genital area. The improved mechanism must overcome the problems associated with prior art devices.

SUMMARY OF THE INVENTION

In accordance with one embodiment of the present invention, it is an object of the present invention to provide an improved mechanism to allow easy access to the genital area.

It is another object of the present invention to provide an improved mechanism to allow easy access to the genital area that overcomes the problems associated with the prior art.

BRIEF DESCRIPTION OF THE EMBODIMENTS

In accordance with one embodiment of the present invention a unisex garment is disclosed. The unisex garment has a waistband. A pair of leg members extend down from the waistband. A mechanism is coupled to the unisex garment to allow easy opening of the crotch area to access the genitals. The mechanism comprises a zipper running from a crotch seam positioned between the pair of leg members to a belt line just below the waistband wherein upward movement of a handle will open the zipper. A plurality of quick release fasteners run from a top section of the crotch seam towards pant inseams on both pair of leg members.

In accordance with another embodiment of the present invention, a unisex garment is disclosed. The unisex garment has a waistband. A pair of leg members extend down from the waistband. A mechanism is coupled to the garment to allow the easy opening of the crotch area to access the genitals. The mechanism has a zipper running from a crotch seam positioned between the pair of leg members to a belt line just below the waistband, wherein upward movement of a handle will open the zipper. The zipper has a pair of zipper tracks running parallel from the crotch seam positioned between the pair of leg members to the belt line just below the waistband. Each zipper track has a plurality of teeth. A latching mechanism is coupled to the pair of zipper tracks for latching every hook on each of the pair of zipper tracks. A handle is coupled to the latching mechanism for pulling the latching mechanism in an upward manner to open the zipper and a downward manner to close the zipper. A plurality of quick release fasteners run from a top section of the crotch seam towards pant inseams on both pair of leg members. Each of the plurality of quick release fasteners comprises a first component coupled to each side of an interior flap section formed by the zipper and a second component coupled to the top section of the crotch seam.

The foregoing and other objects, features, and advantages of the invention will be apparent from the following, more particular, description of the preferred embodiments of the invention, as illustrated in the accompanying drawing.

BRIEF DESCRIPTION OF THE DRAWINGS

The novel features believed characteristic of the invention are set forth in the appended claims. The invention itself, as well as a preferred mode of use, and advantages thereof, will best be understood by reference to the following detailed description of illustrated embodiments when read in conjunction with the accompanying drawings.

FIG. 1A is a magnified view of another embodiment of the present invention having hook and loop fasteners.

DETAILED DESCRIPTION OF THE PREFERRED EMBODIMENT

Figure 1:
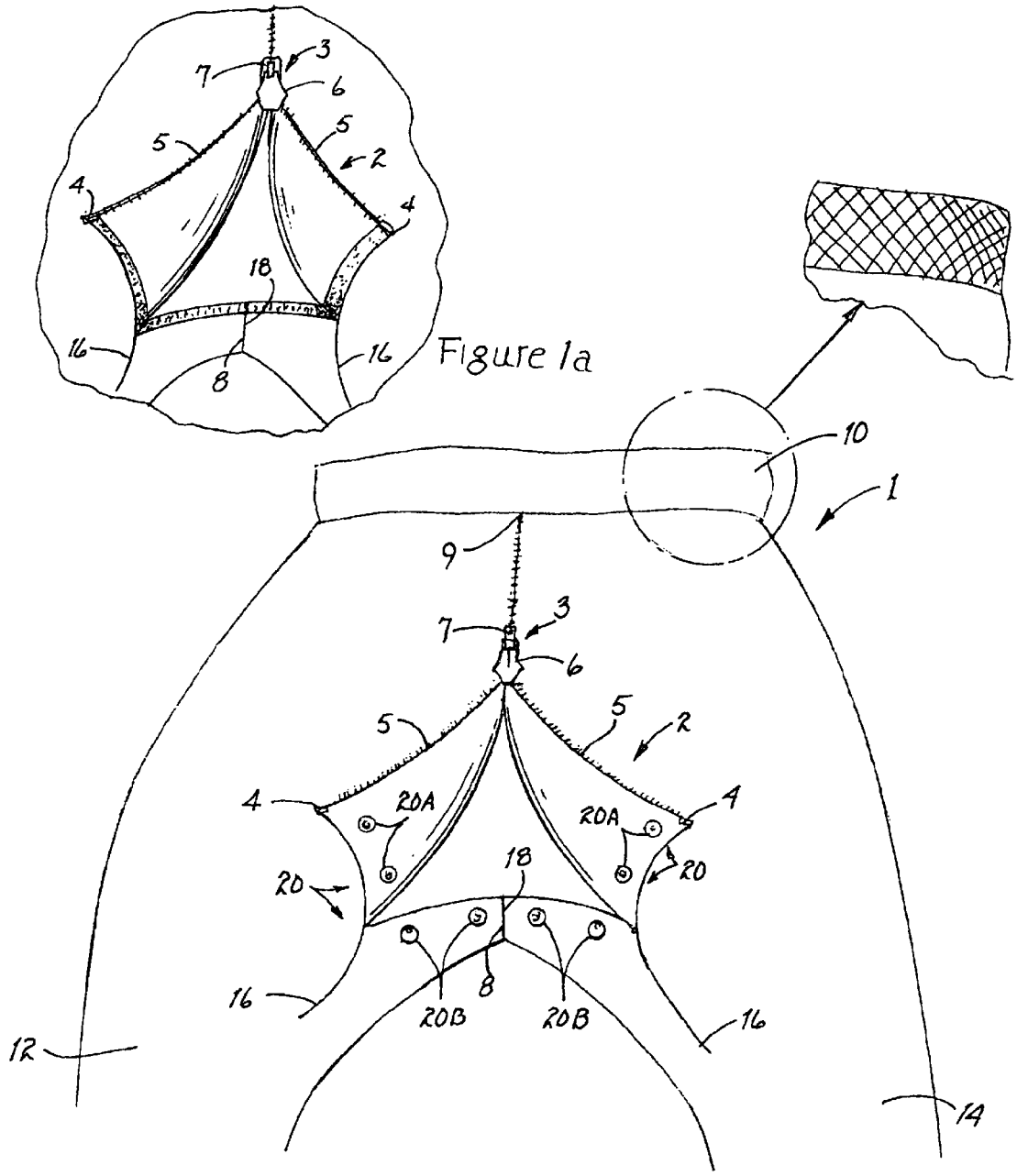
FIG. 1 is a front view of the mechanism to allow easy access to the genital area with the mechanism partial open with a magnified view of the elastic waistband.

Referring to FIG. 1, a new pair of pants 1 having a mechanism 2 to allow the easy opening of the crotch area is shown. The pants 1 are similar to an ordinary pair of pants. The pants 1 have a waistband 10. The waistband 10 may be an elastic type waistband 10 to allow the waistband to extend to the size of the wearer. Two leg members 12 and 14 extend downwardly from the waistband 12. The leg members 12 and 14 will come in different lengths to accommodate the different heights of the wearers. The pants 1 may further include pockets (not shown) formed on each leg member 12 and 14 to allow a wearer to store and hold different items.

The pants 1 will have a mechanism 2 to allow the easy opening of the crotch area to access the genital to relieve bodily functions or for other reasons. The mechanism 2 will have a zipper 3 and a plurality of fasteners 20.

The zipper 3 is a standard type zipper having a pair of zipper tracks 4 made up of dozens of teeth 5, each of which combines a hook and a hollow. A latching mechanism, hereinafter called a slide 6, is used to latch every hook on each of the two tracks 4 into a hollow on the opposite track 4 in order to close the zipper 3. Unlike prior art zippers, the zipper 3 is installed so that an upward movement of the handle 7 will open the zipper 3. Thus, as one pulls the handle 7 in an upward manner, the slide 6 moves up the zipper 3. The slide 6 pushes against the slanted edges of the hooks, pivoting each tooth 5 off of the tooth 5 below it thereby opening the zipper tracks 4. Pulling downward on the handle 7 closes the zipper 3. As the zipper tracks 4 move through the slide 6, the slide's inclined edges push the teeth 5 toward each other. The zipper tracks 4 are offset from each other, so each hollow settles onto a hook in sequence. The zipper 3 will generally run from the crotch seam 8 to the belt line 9.

The zipper 3 will allow faster access to the genitals since it is easier for one to pull the zipper 3 upward as opposed to downward since one will have more leverage pulling up as opposed to down. Furthermore, if one pulls a prior art zipper downward too fast/hard, prior art zippers have a tendency to twist or bunch up. There by not allowing one to open the prior art zipper.

On both the pant inseams 16, starting from a top section 18 of the crotch seam 8, fasteners 20 are coupled to the pants 1 every inch or so towards the inseam 16. The fasteners 20 are used to hold down a crotch covering flap assembly formed by the bottom of the zipper 3 and the interior of the pants 1 around the top section 18 of the crotch seam 8. The fasteners 20 are quick release fasteners 20. The fasteners 20 allow one to quickly open the crotch area of the pants 1 and to have a wider opening to access the groin area. In general, the fasteners 20 are comprised of a first member 20A coupled to the crotch covering flap assembly formed by the bottom of the zipper 3 and the interior of the pants 1. A second member 20B is coupled to the interior of the pants 1 around the top section 18 of the crotch seam 8. The fasteners 20 may be hook and loop material (see FIG. 1*a*), button snaps, male and female connectors, and the like.

Figure 2:
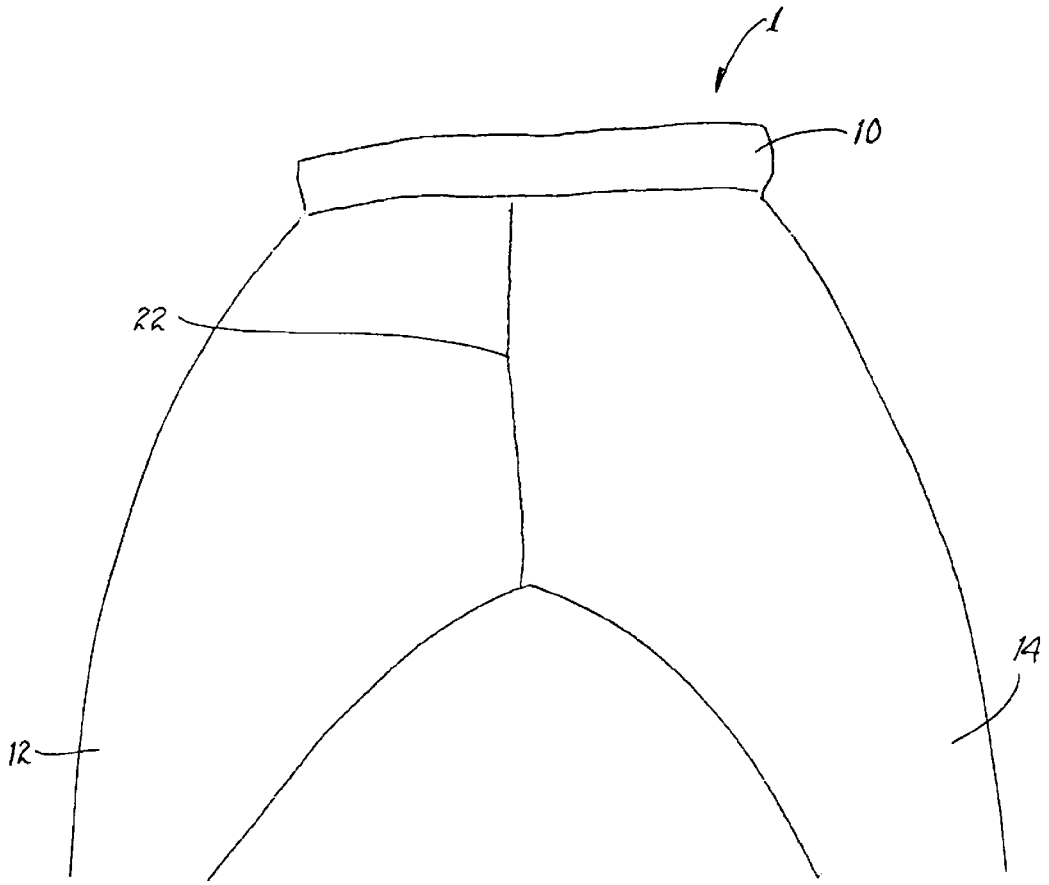
FIG. 2 is a front view of the mechanism to allow easy access to the genital area with the mechanism total closed.

Referring now to FIG. 2, the pair of pants 1 having a mechanism 2 to allow the easy opening of the crotch area is shown again. The embodiment of FIG. 2 is basically the same as that shown in FIG. 1. The main difference is that a flap section 22 is used to cover the zipper 3 so that the zipper 3 is not visible to other people.

The pair of pants 1 having a mechanism 2 to allow the easy opening of the crotch area allows one to easily access one's genitals through the pair of pants 1. By reversing the action of the zipper 3 and adding quick release fasteners 20, there is no obstruction when a person is trying to access his/her genitals. The zipper 3 will allow faster access to the genitals since it is easier for one to pull the zipper 3 upward as opposed to downward. The fasteners 20 allow one to quickly open the crotch area of the pants 1 and to have a wider opening to access the groin area.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A unisex garment comprising:

a waistband;

a pair of leg members extending from the waistband;

a mechanism to allow the easy opening of the crotch area to access the genitals, the mechanism comprising:

a zipper running from a crotch seam positioned between the pair of leg members to a belt line just below the waistband, wherein upward movement of a handle will open the zipper; and a plurality of quick release fasteners running from a top section of the crotch seam towards pant inseams on both pair of leg members.

2. A unisex garment in accordance with claim 1 wherein the zipper comprises:

a pair of zipper tracks running parallel from the crotch seam positioned between the pair of leg members to the belt line just below the waistband, each zipper track having a plurality of teeth;

a latching mechanism coupled to the pair of zipper tracks for latching every hook on each of the pair of zipper tracks; and a handle coupled to the latching mechanism for pulling the latching mechanism in an upward manner to open the zipper and a downward manner to close the zipper.

3. A unisex garment in accordance with claim 1 wherein each of the plurality of quick release fasteners comprises:

a first component coupled to each side of an interior flap section formed by the zipper; and a second component coupled to the top section of the crotch seam.

4. A unisex garment in accordance with claim 3 wherein the first component and the second component are male/female button snaps.

5. A unisex garment in accordance with claim 3 wherein the first component and the second component are hook and loop material.

6. A unisex garment in accordance with claim 1 wherein the waistband is elastic.

7. A unisex garment comprising:

a waistband;

a pair of leg members extending from the waistband;

a mechanism to allow the easy opening of the crotch area to access the genitals, the mechanism comprising:

a zipper running from a crotch seam positioned between the pair of leg members to a belt line just below the waistband, wherein upward movement of a handle will open the zipper, the zipper comprising:

a pair of zipper tracks running parallel from the crotch seam positioned between the pair of leg members to the belt line just below the waistband, each zipper track having a plurality of teeth;

a latching mechanism coupled to the pair of zipper tracks for latching every hook on each of the pair of zipper tracks; and a handle coupled to the latching mechanism for pulling the latching mechanism in an upward manner to open the zipper and a downward manner to close the zipper; and a plurality of quick release fasteners running from a top section of the crotch seam towards pant inseams on both pair of leg members, wherein each of the plurality of quick release fasteners comprises:

a first component coupled to each side of an interior flap section formed by the zipper; and a second component coupled to the top section of the crotch seam.

8. A unisex garment in accordance with claim 7 wherein the first component and the second component are male/female button snaps.

9. A unisex garment in accordance with claim 7 wherein the first component and the second component are hook and loop material.

10. A unisex garment in accordance with claim 7 wherein the waistband is elastic.

* * * * *